US007722284B1

(12) United States Patent
Somwong

(10) Patent No.: US 7,722,284 B1
(45) Date of Patent: May 25, 2010

(54) TRAFFIC IMPACT ATTENUATOR

(76) Inventor: Banyat Somwong, 13063 Strathern St., North Hollywood, CA (US) 91605

( * ) Notice: Subject to any disclaimer, the term of this patent is extended or adjusted under 35 U.S.C. 154(b) by 9 days.

(21) Appl. No.: 12/283,123

(22) Filed: Sep. 10, 2008

(51) Int. Cl.
*E01F 15/00* (2006.01)

(52) U.S. Cl. ..... 404/6

(58) Field of Classification Search ..... 404/6, 404/9

See application file for complete search history.

(56) References Cited

U.S. PATENT DOCUMENTS

| | | | | | |
|---|---|---|---|---|---|
| 3,503,600 | A * | 3/1970 | Rich | 267/116 |
| 4,047,701 | A * | 9/1977 | Glaesener | 256/13.1 |
| 4,200,310 | A * | 4/1980 | Carney, III | 280/784 |
| 4,255,986 | A * | 3/1981 | Mukoyama | 74/492 |
| 4,407,484 | A * | 10/1983 | Meinzer | 256/13.1 |
| 4,822,206 | A * | 4/1989 | Roussel et al. | 404/6 |
| 4,823,923 | A * | 4/1989 | Moyer | 188/376 |
| 4,824,282 | A * | 4/1989 | Waldecker | 404/6 |
| 5,217,318 | A * | 6/1993 | Peppel | 404/6 |
| 5,403,113 | A * | 4/1995 | Gertz et al. | 404/6 |
| 5,466,088 | A * | 11/1995 | Nasatka | 404/6 |
| 5,875,875 | A * | 3/1999 | Knotts | 188/374 |
| 6,179,516 | B1 * | 1/2001 | Ivey et al. | 404/6 |
| 6,308,809 | B1 * | 10/2001 | Reid et al. | 188/377 |
| 6,439,802 | B1 * | 8/2002 | Duckett | 404/6 |
| 6,554,529 | B2 * | 4/2003 | Stephens et al. | 404/6 |
| 6,962,459 | B2 * | 11/2005 | Smith et al. | 404/6 |
| 7,300,223 | B1 * | 11/2007 | Kennedy et al. | 404/6 |
| 2005/0036832 | A1 * | 2/2005 | Smith et al. | 404/6 |
| 2006/0104713 | A1 * | 5/2006 | Gelfand et al. | 404/6 |

* cited by examiner

*Primary Examiner*—Raymond W Addie

(57) ABSTRACT

A Freeway Impact Attenuator is a traffic control or traffic accident impact absorbing device that will be deployed and replaced the conventional sand filled plastic buckets on the highway exits, junctions and temporary highway constructions. The rear support bracket for the temporary deployment to be replaced with concrete block to keep the unit from sliding.

The bumper and sliding tube move backwards and simultaneously the water in the cylinder get compressed while piston also moves backwards once impact force exerted to the bumper. The sliding tube and piston is interfaced through the clamp.

When the water pressure increases to the level that cylinder piston reaction force overcome the impact, sliding tube will stop prior to the end of cylinder full stroke.

Water level inside the tank will also increase and may over flow in some case is depending on the piston traveling in the cylinder.

9 Claims, 4 Drawing Sheets

SIDE ELEVATION CROSS SECTION
AT NORMAL POSITION

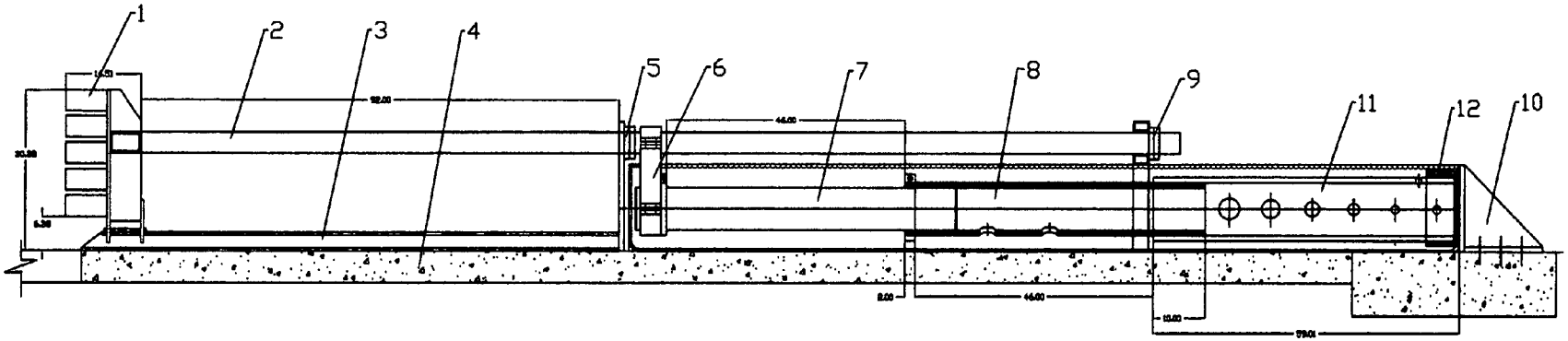
FIG 1. SIDE ELEVATION CROSS SECTION AT NORMAL POSITION

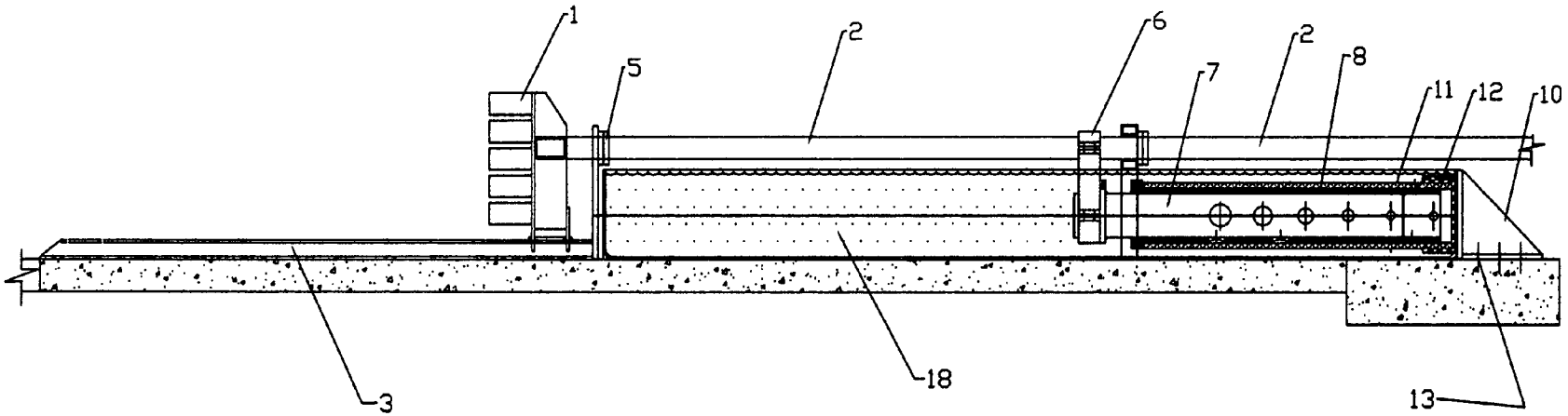
FIG 2. SIDE ELEVATION CROSS SECTION
AT FULLY RETRACTED WHEN HIT BY HEAVY VEHICLE

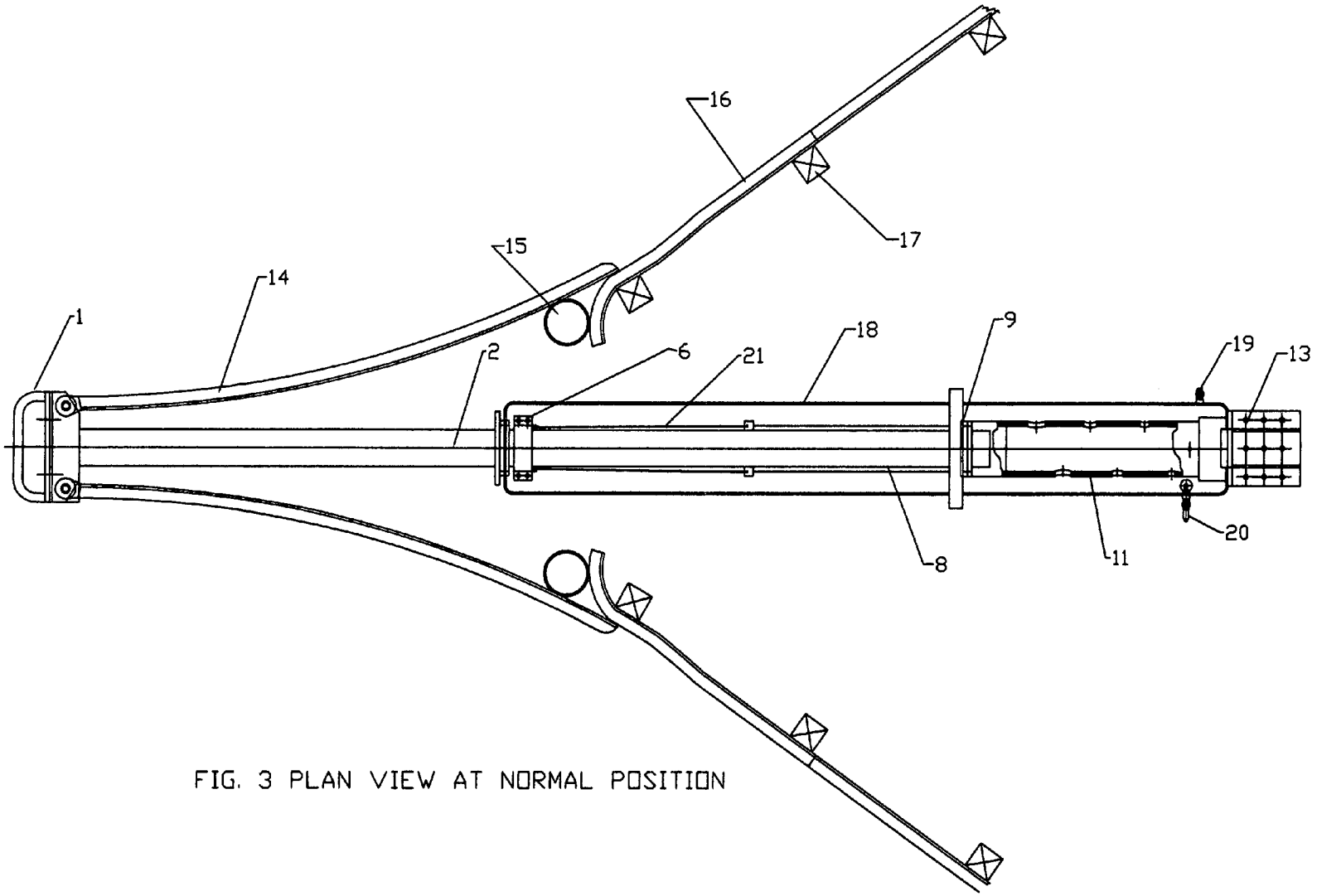
FIG. 3 PLAN VIEW AT NORMAL POSITION

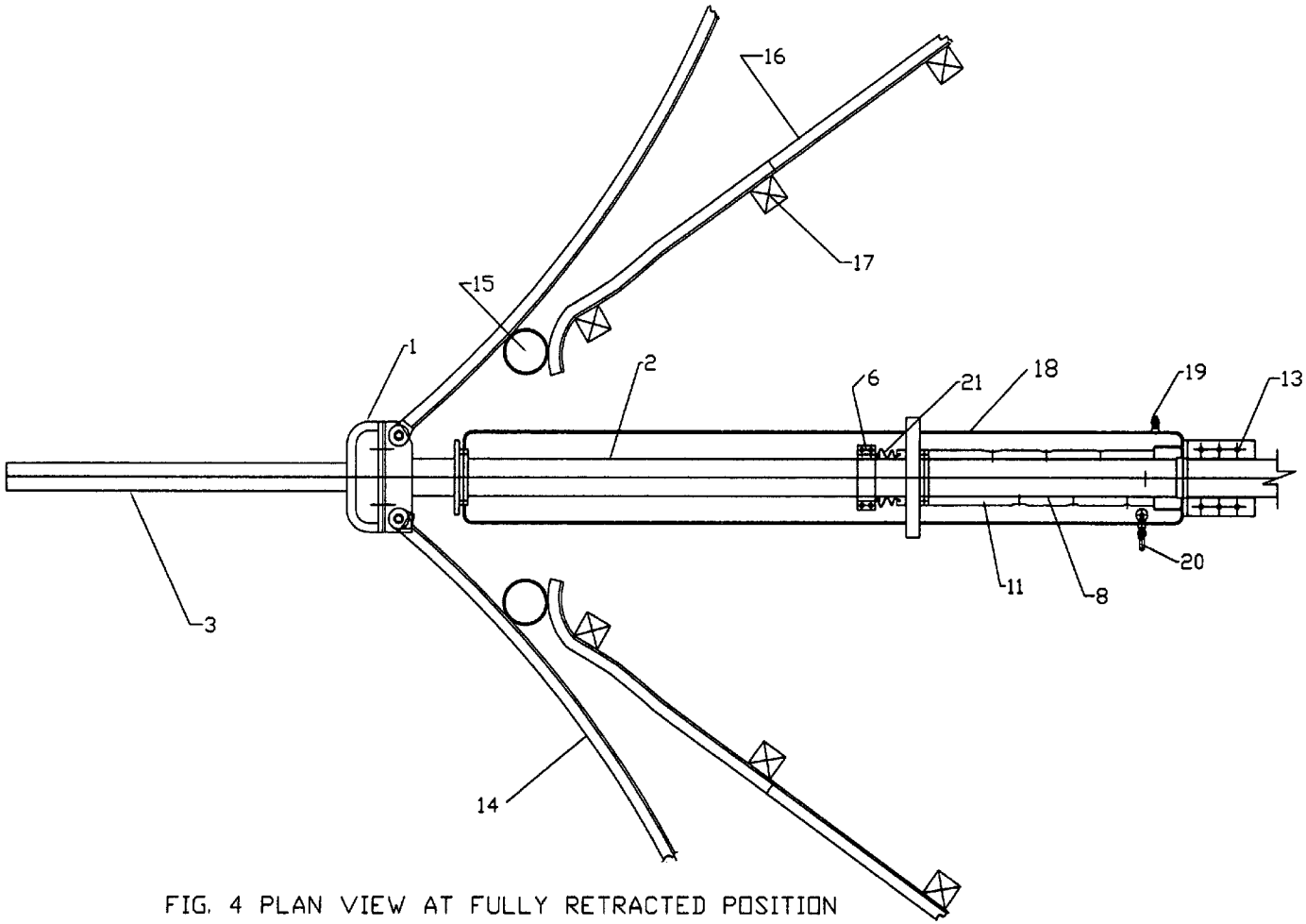
FIG. 4 PLAN VIEW AT FULLY RETRACTED POSITION WHEN HIT BY HEAVY VEHICLE

TRAFFIC IMPACT ATTENUATOR

CROSS-REFERENCE TO RELATED APPLICATIONS

"Not applicable"

STATEMENT REGARDING FEDERALLY SPONSORED RESEARCH OR DEVELOPMENT

"Not applicable"

THE NAMES OF THE PARTIES TO A JOINT RESEARCH AGREEMENT

"Not applicable"

INCORPORATION-BY-REFERENCE OF MATERIAL SUBMITTED ON A COMPACT DISC

"Not applicable"

BACK GROUND OF THE INVENTION (1) Field of the Invention

The invention relates generally to the traffic control system on the Freeway or Hiway where vehicles speed exceeding forty miles per hour. Vehicle accident at this speed level could create major damage to the vehicles and casualties to the occupants.

The concept behind "Traffic Impact Attenuator" is to prevent serious casualty and vehicle damages in case of lost control and run into guard rail or cushion drums at Freeway exit or median.

(2) Prior Art

Existing impact absorbing device installed on the Freeway ramps, is made of plastic drums installed in series up to five or six drums. Drums are filled with sand to secure drum movement and absorb impact from vehicles. This type of absorbing device is not affective and could cause more damage to vehicles and casualty to the vehicle occupants.

Each time after accident, clean up effort can take hours to move plastic debris and sand that spread all over the place on the traffic surface. If clean up effort can not be done promptly, sand on the surface can potentially cause more accident is due to slippage to the next vehicle exit at the same location.

"Traffic Impact Attenuator" after an accident can be restored to the same condition within a short period of time. Sliding tube can be moved to the previous location by pickup truck or human force.

"Traffic Impact Attenuator" is the right solution for this type of application that related to human lives and property lost in each of an accident. "Traffic Impact Attenuator" offers less impact force and required no clean up effort after an accident. Deceleration rate of the vehicle is far less than other drum type because of longer displacement prior to complete stop. As a result the impact exerted to the vehicle is drastically reduced relative to deceleration rate.

BRIEF SUMMARY OF THE INVENTION

The Traffic Impact Attenuator of the invention incorporates a rubber bumper and a guide tube, guide bearings, a clamp, a hold down T-rail, a telescopic shock absorber, a water tank with cover, a water level control valve, a drain valve and a rear support bracket.

A rubber bumper is mounted on a guide tube and the guide tube is interconnected to a telescopic shock absorber through a clamp. The guide tube has two guide bearings. The guide tube front end is restrained with hold down T-rail.

The telescopic shock absorber is encased in a water tank below guide tube. The telescopic shock absorber is filled up with water. the distal end of the telescopic shock absorber is mounted to the tank wall and supported by a rear support bracket. The support bracket is anchored to the concrete foundation.

The main cylinder of a shock absorber is provided with series of holes in difference sizes and arranged so that the largest hole is located closest to the main cylinder open end. Water inside the main cylinder moves freely from the main cylinder to the tank through passage holes in normal condition. Total cross section area of holes on cylinder wall is less than cross section area of the cylinder.

Water supply to the water tank is provided from an irrigation system or water truck. The water tank also has drain valve to empty the tank as required.

As a vehicle is accidentally crashed into the Traffic Impact Attenuator, the bumper absorbs some impact and begins sliding backwards along the guide. The impact energy is transferred from guide tube to the telescopic shock absorber.

The cylinder pressure is increasingly changed through out the movement of a piston.

Once the cylinder pressure overcomes impact force, the piston will stop prior to bottom out. If the impact force is greater than the force created by the pressure, the piston will move further to the end of the stroke. All the holes on the wall are overlapped by a piston. At this position the pressure inside the piston is drastically increased and brings the piston to stop. The impact force that is exerted to the cylinder rear end will be transferred to the foundation via rear support bracket.

The Traffic Impact Attenuator is a durable and maintenance free unit, the major immersed components to be made of stainless steel, PVC or fiberglass as required to prevent corrosion and sustain pressure.

BRIEF DESCRIPTION OF THE SEVERAL VIEWS OF THE DRAWINGS

Details of the invention will be clearly understood with reference to the followings:

FIG. 1 Side elevation cross section at normal position

FIG. 2 Side elevation cross section at fully retracted when hit by heavy vehicle.

FIG. 3 Plan view at normal position.

FIG. 4 Plan view at fully retracted position when hit by heavy vehicle.

DETAILED DESCRIPTION OF THE INVENTION

Referring to the drawings, FIG. 1 discloses the embodiment of the invention for a Freeway Impact Attenuator. The rubber bumper 1 is connected to a rectangular guide tube front face 2, guide tube hold down T-rail 3, front guide bearing 5 and, rear guide bearing 9.

The guide tube 2 interconnected to a telescopic shock absorber piston 7 through a clamp 6, the piston is housed in intermediate cylinder 8 and main cylinder 11 respectively. A main cylinder end cap is mounted to the water tank wall 8.

The tank rear wall rests directly against rear support bracket 10 and is anchored to the footing 4 through anchor bolts 13.

The rubber bumper 1 is arranged so that a vehicle bumper from 6 inches to 30 inches above ground surface can be intercepted.

As shown on the design, deceleration displacement of the vehicle is around 87 inches at this distance, the impact from vehicle is greatly reduced and prevent loss of life.

The deceleration displacement can be increased depending on space available.

FIG. 2 illustrates the embodiment of the invention for a Freeway Impact Attenuator in a side view, guard rails 14 are articulately connected to guide tube front face via pins and on the other ends are supported by steel posts 15. Guard rails 16 are stationary parts and the posts 17 are the same as those used for the traffic control.

Water tank 18 is at least partially filled up with water which is to be used as shock absorber fluid that is located inside the tank. The water tank is enclosed with a cover to avoid contamination. Replenish and flow control valve 20 and drain valve 19 are provided to serve the purpose as required to maintain proper function of the system.

What is claimed is:

1. A traffic impact attenuator comprising:

A rubber bumper attached to a guide tube, the rubber bumper intended to be impacted by an errant vehicle;

A tank filled with a liquid, and further comprising:

A piston, intermediate cylinder and main cylinder; the piston and intermediate cylinder being movable linearly into the main cylinder, between proximal and distal ends of said main cylinder;

A rear support bracket connected to a distal end of the main cylinder;

Wherein at least a portion of the guide tube is held in an elevated position above the fluid tank, by front and rear bearings, such that the guide tube and rubber bumper are linearly movable during a vehicle impact, along the length of the tank;

Further wherein, the guide tube is connected to the piston, such that linear movement of the guide tube is translated into linear movement of the piston and intermediate cylinder.

2. The traffic impact attenuator of claim 1 further comprising:

A plurality of exhaust holes disposed along the length of the main cylinder;

Wherein a fluid disposed inside the intermediate tank and main tank are expelled from the main tank through said exhaust holes.

3. The traffic attenuator of claim 2, wherein the intermediate cylinder closes the exhaust holes of the main tank, as the intermediate cylinder slides along the length of the main cylinder.

4. The traffic attenuator of claim 1 wherein the guide tube has a rectangular cross section and is attached to the piston by a clamp.

5. The traffic attenuator of claim 2, wherein the plurality of exhaust holes vary in size from largest to smallest, with the largest exhaust hole being proximate the proximal end of the main cylinder.

6. The traffic attenuator of claim 5, wherein un-attenuated fluid pressure, is transferred to the support bracket at the end of the piston stroke.

7. The traffic attenuator of claim 1, wherein the tank includes inflow and drain valves, such that a fluid can be introduced into the tank and drained therefrom.

8. The traffic attenuator of claim 1 wherein the rubber bumper and guide rail are further connected to a pair of movable guard rails, disposed on either side of said guide rail via pin connectors, the guard rails are supported at a distal end thereof by posts, such that the guard rails slide along the posts as the guide tube is moved by an impacting vehicle.

9. The traffic attenuator of claim 1 further comprising a pair of cables connected between the clamp and intermediate cylinder, such that, when the rubber bumper, guide rail and piston are returned to the operational position, from a collapsed position, the intermediate cylinder is withdrawn from the main cylinder.

* * * * *